US010070733B2

(12) United States Patent
Ohno et al.

(10) Patent No.: US 10,070,733 B2
(45) Date of Patent: Sep. 11, 2018

(54) AIR MATTRESS HAVING INFLATING AND DEFLATING FUNCTIONS

(71) Applicant: PARAMOUNT BED CO., LTD., Tokyo (JP)

(72) Inventors: Kenta Ohno, Tokyo (JP); Makoto Tanaka, Tokyo (JP); Shinji Ueki, Tokyo (JP)

(73) Assignee: PARAMOUNT BED CO., LTD., Tokyo (JP)

( * ) Notice: Subject to any disclaimer, the term of this patent is extended or adjusted under 35 U.S.C. 154(b) by 0 days.

(21) Appl. No.: 15/324,703

(22) PCT Filed: Jun. 29, 2015

(86) PCT No.: PCT/JP2015/068648

§ 371 (c)(1),
(2) Date: Jan. 7, 2017

(87) PCT Pub. No.: WO2016/006487

PCT Pub. Date: Jan. 14, 2016

(65) Prior Publication Data

US 2017/0202364 A1 Jul. 20, 2017

(30) Foreign Application Priority Data

Jul. 9, 2014 (JP) ..... 2014-141170

(51) Int. Cl.

| | |
|---|---|
| ***A47C 27/10*** | (2006.01) |
| ***A47C 27/08*** | (2006.01) |
| ***A61G 7/057*** | (2006.01) |

(52) U.S. Cl.

CPC ..... *A47C 27/10* (2013.01); *A47C 27/082* (2013.01); *A47C 27/083* (2013.01); *A61G 7/057* (2013.01)

(58) Field of Classification Search

CPC ..... A47C 27/10

(Continued)

(56) References Cited

U.S. PATENT DOCUMENTS 6,698,046 B1 * 3/2004 Wu ..... A47C 27/082 137/625.15

8,712,591 B2 4/2014 Receveur (Continued)

FOREIGN PATENT DOCUMENTS

JP 2011-120896 A 6/2011
JP 2011-160897 A 8/2011

(Continued)

OTHER PUBLICATIONS

International Search Report for corresponding International Application No. PCT/JP2015/068648 dated Aug. 11, 2015.

*Primary Examiner* — Fredrick C Conley

(74) *Attorney, Agent, or Firm* — Renner Otto Boisselle & Sklar, LLP

(57) ABSTRACT

When, at the initial operation of an air mattress having inflating and deflating functions or at restarting after maintenance, many air cells need to be filled with a large amount of air, the air supply/discharge pump is operated at a driving force (the first power output) close to the maximum driving capacity thereof in order to inflate the air cells as soon as possible. In the normal operation in which the bed user is lying on the bed, when the air supply/discharge pump needs to be driven in order to cause alternate inflation and deflation or in order to prevent the user from touching the bottom, the air supply/discharge pump is driven at a second or third power output lower than the first power output. Thereby, it is possible in the air mattress having inflating and deflating functions to achieve rapid pressure adjustment and alleviate (Continued)

bed user's discomfortable feeling due to the operation noise of the pump upon the pressure adjustment.

10 Claims, 3 Drawing Sheets

(58) Field of Classification Search
USPC ..... 5/710–713, 706
See application file for complete search history.

(56) References Cited

U.S. PATENT DOCUMENTS

2012/0304385 A1 12/2012 Ishibashi et al.
2012/0311790 A1* 12/2012 Nomura ..... A61G 7/05776
5/710

FOREIGN PATENT DOCUMENTS

JP 2014-046043 A 3/2014
JP 2014-083141 A 5/2014

* cited by examiner

AIR MATTRESS HAVING INFLATING AND DEFLATING FUNCTIONS

TECHNICAL FIELD

The present invention relates to an air mattress with a plurality of air cells extending to the bed width direction and being arranged in parallel in the bed longitudinal direction, in particular relates to an air mattress having inflating and deflating functions that prevents the bed user from getting bedsores and others by alternately inflating and deflating the plurality of air cells.

BACKGROUND ART

An air mattress is a mattress that has a plurality of air cells extending to the bed width direction and being arranged in parallel in the bed longitudinal direction and is provided with cushioning properties by supplying the art to each air cell and inflating and inflating each air cell (Patent Document 1). There has been a kind of air mattress which is controlled so that the air cells are alternately inflated and deflated one to another. This configuration makes it possible to effectively prevent the bed user from getting bedsores compared to the case where the bed user is lying on the air mattress continuously. In this alternate inflation and deflation, for a plurality of the air cells, every third cell, for example, is repeatedly contracted and expanded at the same timing. That is, for the air cells arranged in the bed longitudinal direction, from all the air cells being inflated, the first air cell, fourth air cell, seventh air cell, . . . are deflated (air-discharged) by reducing the pressure in these cells, then these cells are pressurized (air-supplied) and returned to the expanded state. Subsequently, the second air cell, fifth air cell, eighth air cell, . . . are deflated by reducing the pressure, then these cells are returned to the expanded state by increasing the pressure in these cells. Then, the third air cell, sixth air cell, ninth air cell are placed under the same pressure control. Thereafter, the first and other associated air cells are implemented with same pressure control. Thus, the pressure of the air cells is controlled in this way to alternately inflate and deflate the air cells, whereby it is possible to prevent the bed user from getting bedsores and others.

On the other hand, diaphragm type pumps are usually used to supply and discharge air for air cells. In the diaphragm type pump, the diaphragm is moved reciprocatedly by reciprocate drive of the diaphragm by means of a linear motor for making linear motion, to thereby supply air to the air cells and discharge air from the air cells.

PRIOR ART DOCUMENTS

Patent Documents

Patent Document 1:
Japanese Patent Application Laid-open 2014-46043

SUMMARY OF THE INVENTION

Problems to be Solved by the Invention

Incidentally, when this air mattress is initially operated or when restarted after maintenance, it is necessary to supply the air into all the cells from the pressureless state until the pressure of all the air cells is raised to a predetermined level to inflate the air mattress. On this occasion, there is a demand at the initial operation or at the restart operation that the air pressure should be raised from zero to the predetermined level as soon as possible. For example, when a patient is hospitalized, the air mattress is inflated by supplying air into all the cells so that the pressure of each air cell is raised to a predetermined level. That is, when a patient is admitted to hospital, the nurse needs to receive the patient, but has to perform the work of pumping air into all the cells of the mattress by providing preparatory period in advance before the reception. Conventionally, it took about 30 minutes to make preparations or inflate all the air cells up to the predetermined pressure level from a state of pressureless. That is, the nurses could not accept the patient until a lapse of the time for preparation. This was a wasteful waiting time for nurses. In order to avoid this, a high-capacity supplying and discharging pump is provided separately in addition to the supplying and discharging pump for use in normal situation and it is necessary fey this high-capacity pump to supply air to the air mattress to thereby make the air mattress available at the time of initial operation or at the time of restart operation. This poses problems of cost increase and complexity in operation.

Further, when the air cells are alternately inflated and deflated in order to prevent the patient lying on the air mattress from getting bedsores as mentioned above, a motorized diaphragm type pump is needed to perform air-supply to and air-discharge from the air cells. Since driving the diaphragm type pump gives off noise, there is a case that the driving sound of this pump becomes hard on the ears for some patient lying on the mattress.

Further, considered as an opportunity when the air pressure of the air mattress is adjusted is an occasion when, in a gatch bed capable of back-tilting operation for raising and lowering the back bottom, pressure control of the air mattress is performed so as to increase the pressure of, for example, only the cells around the buttocks in order to prevent the bed user's body from sinking into the air mattress due to local application of the user weight to the air mattress at the time of back raising. In contrast, at the time of back lowering operation, the pressure of the pressurized air cells around the buttocks is lowered to be as low as the air cells of the other part. At the time of back-raising and back-lowering operations of the gatch bed, the bed user may be offended by the operating sound of the motor-driven diaphragm type pump.

The present invention has been devised in view of the above problems, it is therefore an object of the present invention to provide an air mattress having inflating and deflating functions, which can achieve speedy pressure adjustment and alleviate an unpleasant feeling of the bed user as result of pump operation noise at the time of pressure adjustment.

Means for Solving the Problems

An air mattress having inflating and deflating functions according to the present invention includes:

- a plurality of air cells, the air cells extending to a bed width direction and being arranged in parallel in a bed longitudinal direction;
- an air supply/discharge pump for performing air supply and air discharge for each of the air cells; and,
- a controller that controls the air supply and the air discharge for each of the air cells by the air supply/discharge pump to control increase and degrease of air pressure inside the air cells, wherein the air supply/discharge pump has a capability of applying air to the air cells from a pressureless state in which all the air cells are pressureless to an inflated state in which all the air cells are inflated to a maximum pressure, within a predetermined period of time, and, the controller sets the power of the pump at a first power output equal to or lower than a maximum capacity when the pump inflates the air cells from the state in which the air cells are pressureless to a normal use state, and, the power of the pump is set at a second power output lower than the first power output in an alternate inflation and deflation operation at a time when the air cells are selectively and alternately inflated and deflated.

Another air mattress having inflating and deflating functions according to the present invention includes:

a plurality of air cells, the air cells extending to a bed width direction and being arranged in parallel in a bed longitudinal direction;

an air supply/discharge pump for performing air supply and air discharge for each of the air cells; and a controller that controls the air supply and air discharge for each of the air calls by the air supply/discharge pump to control increase and degrease of air pressure inside the air cells, wherein the air supply/discharge pump has a capability of supplying air to the air cells from a pressureless state in which all the air cells are pressureless to an inflated state in which all the air cells are inflated to a maximum pressure, within a predetermined period of time, and, the controller sets the power of the pump at a first power output equal to or lower than a maximum capacity when the air mattress is initially operated or when restarted after maintenance, and the power of the pump is set at a second power output lower than the first power output when the air cells are selectively inflated.

Still another air mattress having inflating and deflating functions according to the present invention includes:

a plurality of air cells, the air cells extending to a bed width direction and being arranged in parallel in a bed longitudinal direction;

an air supply/discharge pump for performing air supply and air discharge for each of the air cells; and a controller that controls the air supply and the air discharge for each of the air cells by the air supply/discharge pump to control increase and degrease of air pressure inside the air cells, wherein the air supply/discharge pump has a capability of supplying air to the air cells from a pressureless state in which all the air cells are pressureless to an inflated state in which all the air cells are inflated to a maximum pressure, within a predetermined period of time, and, the controller sets the power of the pump at a first power output equal to or lower than a maximum capacity when a patient undergoes rehabilitation, when the patient sits at an edge of a bed, or when back raising is operated in a gatch bed, and, the power of the pump is set at a second power output lower than the first power output when the air cells are selectively inflated.

In these air mattresses having inflating and deflating functions, for example, the air mattress is set on a plurality of bottoms including a back bottom and is used to a gatch bed performing a back raising operation for raising the back bottom, and, the controller sets the power of the pump at a third power output lower than the first power output when the pressure of the air cells located corresponding to a buttock of a bed user is increased at the time of the back raising operation.

Further, for example, the air cells arranged in a longitudinal end on a leg side may be sized shorter with respect to the bed width direction than those in the other part while the air supply/discharge pump may be mounted in a space on the bed between the short-sized air cells and the bed side edge where no air cells occupy.

Advantages of the Invention

According to the present invention, when the air supply/discharge pump needs to supply a large amount of air into the air cells such as when the air mattress is initially operated or restarted after maintenance (the first mode), the controller drives the air supply/discharge pump at the first power output close to its maximum capacity. For example, when in the normal operation mode to actuate alternate inflation and deflation, the bed user is lying on the bed (the second mode), the controller drives the air supply/discharge pump at the second power output lower than the first power output. In this way, since the air supply/discharge pump is driven at the first power output close to the maximum capacity in the first mode, the air cells can be inflated quickly so as to enable rapid preparation. In this case, since the air supply/discharge pump operates at nearly the maximum capacity, the pump gives off high-level operation noise. On the other hand, in the second mode, since the controller operates the air supply/discharge pump at the second power output that is lower than the first power output, the operating sound of the air supply/discharge pump is low so that the noise will not make the bed user lying on the bed uncomfortable. In particular, for example, when the air supply/discharge pump is arranged near the leg section on the bed, the operation sound of the air supply/discharge pump at normal alternate inflation and deflation would make the bed user (the patient and the like lying on the bed) uncomfortable. However, the present invention has an advantage of not producing such an uncomfortable feeling.

MODE FOR CARRYING OUT THE INVENTION

Figure 1:
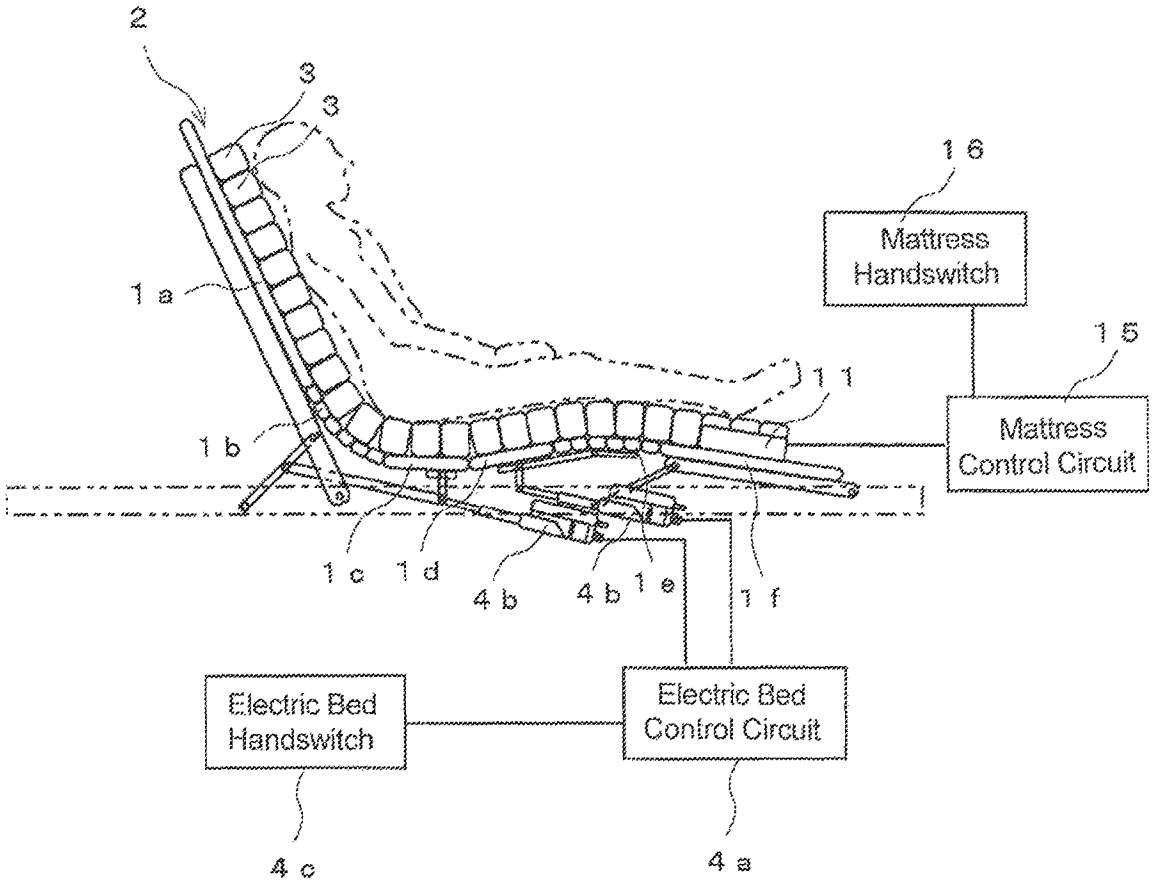
FIG. 1 A diagram showing a gatch bed using an air mattress of the embodiment of the present invention.
Figure 2:
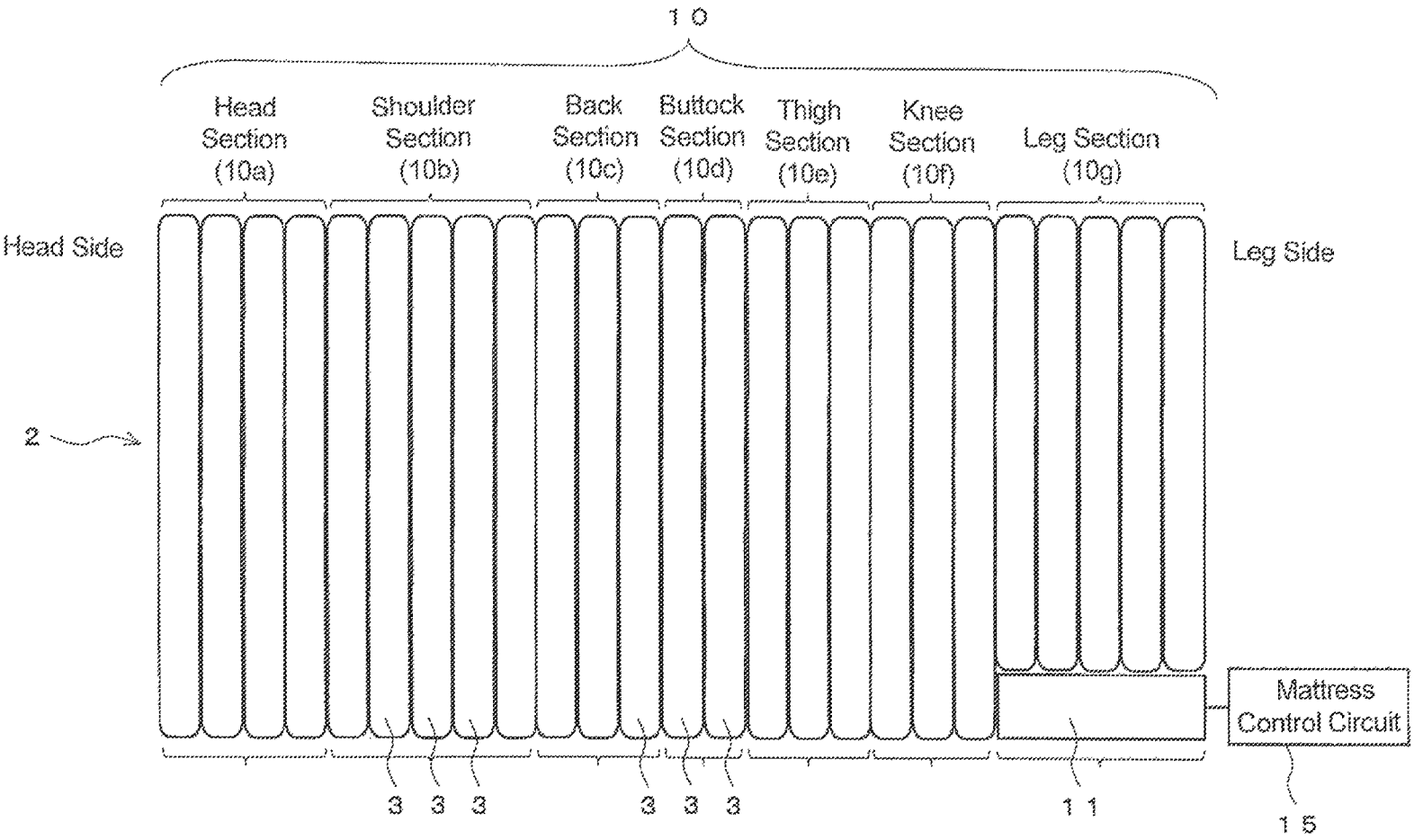
FIG. 2 A plan view showing the air mattress of the embodiment of the present invention.
Figure 3:
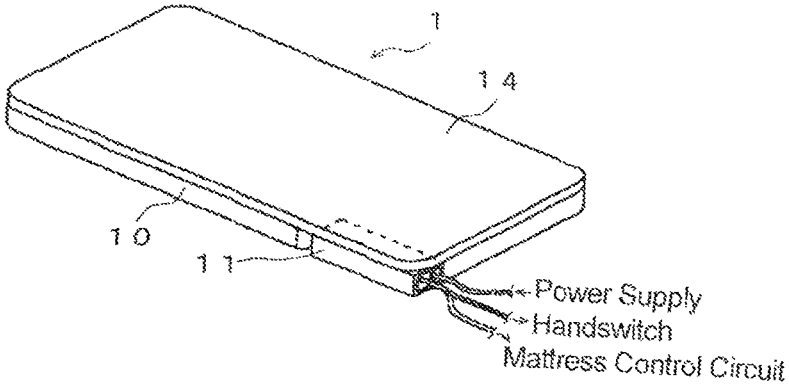
FIG. 3 A perspective view showing the air mattress of the embodiment of the present invention.

Now, the embodiment of the present invention will be specifically described with reference to the accompanying drawings. FIG. 1 is the diagram showing the patch bed using the air mattress 2 of the present embodiment, FIG. 2 is the plan view of the air mattress 2 and FIG. 3 is the perspective view of the air mattress 2. In this gatch bed, a back bottom 1*a*, hip bottom 1*b*, buttock bottom 1*c*, thigh bottom 1*d*, knee bottom 1*e*, leg bottom 1*f* are arranged in the longitudinal direction of the bed. Of these bottoms, the back bottom 1*a*, thigh bottom 1*d* and leg bottom 1*f* can be rotated and moved by means of liking mechanisms and drive cylinders so as to cause the back bottom 1*a* to perform back-raising and back-lowering operation. The thigh bottom 1*d* and leg bottom 1*f* operate subordinatey, following raising and lowering motion of the back bottom 1*a*. The drive cylinders of the back bottom 1*a*, thigh bottom 1*d* and leg bottom 1*f* are controlled by an electric bed control circuit 4*a*. Control commands to the electric bed control circuit 4*a* are given by operating an electric bed handswitch 4*c*.

The gatch bed is an electric bed in which the piston rods at the front ends of actuators 4*b* are moved forward or backward by the operation of the electric bed hand-switch 4*c* so as to move individual bed linking mechanisms coupled to the front ends of the piston rods and thereby electrically actuate each bottom for back-raising or back-lowering operation. For example, the piston rod of actuator 4*b* is provided with a strain gauge as an external sensor (not shown) so as to be able to detect the load applied on the piston rod via the bottom of the electric bed. It is also possible to detect the load applied on the piston rod by being detected the required current for driving the actuator 4*b* by control circuit 4*a*. The electric bed also includes an external sensor (not shown) for detecting the tilt angle of the back bottom for performing back-raising operation. Herein, the electric bed may also be configured to be able to raise the knee bottom at the same time, not limited to the back bottom alone. Also in this case, the strain gauge that is provided for the piston rod of actuator 4*b* coupled to the linking mechanism of the knee bottom can measure the load applied to the knee bottom, in addition, a sensor for detecting the tilt angle of the knee bottom, can also be provided.

Placed on these bottoms 1*a* to 1*f* is the air mattress 2. As shown in FIG. 2, this air mattress 2 is comprised of a plurality of bag-like air cells 3 extending to the bed width direction and being arranged in parallel in the longitudinal direction of the bed. Multiple air cells 3 are arranged in parallel from the head side to the leg side of the bed, correspondingly to each section of the bed user, i.e., head section 10*a*, shoulder section 10*b*, back section 10*c*, buttock section 10*d*, thigh section 10*e*, knee section 10*f* and leg section 10*g*.

All the air cells 3 of head section 10*a*, shoulder section 10*b*, back section 10*c*, buttock section 10*d*, thigh section 10*e*, thigh section 10*e* and knee section 10*f* extend to the full width of the bed, whereas the air cells 3 of leg section 10*g* similarly extend to the bed longitudinal direction but the length is shorter than that of air cells 3 in the other sections. Arranged on the bed between the air cells 3 in this leg section 10*g* and the side edge of the bed is an air supply/discharge pump 11. This air supply/discharge pump 11 is connected to a mattress control circuit 15, to which a mattress handswitch 16 is connected.

The length of air cells 3 in the leg section 10*g* is shorter by 30% or less than that of the other air cells 3. That is, in the assembly of the plurality of bag-like cells so as to be arranged in rectangular as a whole when viewed from the top, there is a space without any bag-like cells 3 at one of the four corners, on the side where the heels of the person lying on the mattress are positioned. Air supply/discharge pump 11 is laid out in this space with no bag-like cells 3, in such a manner that, for example, the longitudinal direction of the pump is extended perpendicularly to the longitudinal direction of each bag-like cell 3, or is extended to the direction from the head toward the legs of the person lying on the mattress. In this way, the air supply/discharge pump 11 is arranged at the corner corresponding to the heels of person lying on the mattress of the four corners of the air mattress 2 that is formed in a rectangular shape as a whole when viewed from the top. This space corresponding to the side of the heels is an area where the body of air-mattress user is unlikely to touch even when he/she tosses about in bed, hence will not offend feeling in bed. Arranging the air supply/discharge pump 11 within the area defined by the length and the width of the air mattress 2 formed of the plurality of air cells 3 makes it unnecessary to mount the pump 11 outside the air mattress 2 and makes it easy to handle. When the height of the air supply/discharge pump 11 is, for example, equal to or lower than the height of the bag-like cell of each air cell group 10, the air supply/discharge pump 11 having a higher hardness than the fully inflated bag-like air cell will be prevented from projecting above the height of air cells 3, hence, for example, in the air mattress 2 set on a bed having side rails, it is possible to prevent the person lying on the air mattress 2 from being positioned higher than the side rails. The air supply/discharge pump 11 is formed with its outer surface covered by a soft material such as ethane or the like, for example, so as to alleviate impacts when the person on the air mattress 2, the caregiver and others come into contact with the air supply/discharge pump 11 as well as to provide a protecting function of the air supply/discharge pump 11.

As shown in FIG. 3, in this embodiment, the plurality of air cells 3 and air supply/discharge pump 11 are covered from their top by a single top cover 14 formed of, for example, a nylon fabric coated with polyurethane. Since the top surface of the air cell assembly 10 and the top surface of air supply/discharge pump 11 are covered by the top cover 14, the air supply/discharge pump 11 is exposed to the outside on one of the lateral side faces with respect to the width direction of air mattress 1, one of the lateral side faces with respect to the longitudinal direction of air mattress 1 where the mattress user's heels are placed, and an under surface thereof. In a case where top cover 14 is set as in this embodiment, a structure for fixing the assembly of the plurality of air cells 3 and/or air supply/discharge pump 11 to the top cover 14 is provided so that air supply/discharge pump 11 is fixed to air cells 3. As shown in FIG. 3, air supply/discharge pump 11 has, for example, an end face exposed to the outside at the longitudinal end of air mattress 1, on which a power supply cable, a cable connected to the mattress control circuit 15 for exchanging signals with the mattress control circuit 15 and a cable for exchanging signals with handswitch 16 are provided. Though the present embodiment includes the handswitch 16, air supply/discharge pump 11 may also be adapted to be driven by power supplied from a power supply while the pressure of air cells 3 may be adjusted by exchange of signals with the mattress control circuit 15.

In the present embodiment, the air supply/discharge pump 11 has such a capability of supplying air to air cells 3 as to inflate all the air cells 3 from the condition where all the air cells 3 are pressureless to the condition where all the cells 3 are inflated to the maximum pressure within a predetermined time. The case where all the cells are pressureless corresponds to, for example, when the air mattress is initially operated or when the air mattress is restarted to operate after maintenance. The predetermined time is the time in which all the air cells 3 are charged with air and inflated until the air mattress 2 can be used. This predetermined time is the time during which the nurse or the like who performs inflating operation is able to wait when the air mattress 2 is initially operated or when it is restarted. If this time is too long, the nurse needs to wait idly in preparing the hospitalization of a patient. Therefore, this waiting time should be made as short as possible. If this waiting time is short, all the air cells 3 of the air mattress 2 can be inflated so that the air mattress 2 can be used while the nurse is explaining other matters required for hospitalization to the patient to be hospitalized. As a result, the patient can use the air mattress 2 immediately after explanation of hospitalization matters from the nurse, and the nurse can set out the next work immediately after the explanation of the hospitalization matters to the patient. Specifically, air supply/discharge pump 11 is driven at a.c. 100V so as to supply air to air cells 3 at a discharge rate of 14 to 17 Nlit./min. In this way, when air cells 3 are inflated from their pressureless state to the normal use state, the pump 11 is set at a first power output close to its maximum capacity so as to inflate all the air cells 3 as soon as possible.

On the other hand, when a patient or a bed user is lying on the bed and the air mattress 2 is in a normal usage condition, there is a case where the air cells 3 are inflated and deflated alternately in order to prevent the patient from getting bedsores. This alternate inflation and deflation means an operation in which, in the air mattress 2 with the plurality of air cells 3 arranged in parallel from the head section 10*a* side to the leg section 10*g* side as shown in FIG. 2, every third air cell 3 is air-discharged (air cell 3 shrinks as a result of pressure decrease) and air-supplied (air cell 3 expands as a result of pressure increase) in the same mode and this expansion and shrinkage is repeated. That is, the air cells 3 are connected, in order from the head section 10*a* side, to the pipes of the first line, the second line and third line, the first line, the second line, the third line, . . . . The air cells are connected to the air supply/discharge pump 11 by way of these three pipe lines, and the mattress control unit 15 controls increase and decrease in air pressure by the air supply/discharge pump 11 independently for each line. That is, from the state where all air cells 3 are fully expanded, the control unit 15 discharges air from the air cells 3 connected to the first line to lower the pressure and then supply air thereto to raise the pressure, thereafter, discharges air from the air cells 3 connected to the second line to lower the pressure and then supply air thereto to raise the pressure. In this way, decrease and increase in pressure is successively performed for every line. In this normal control, one cycle control comprising decreasing and increasing air pressure of the first line, decreasing and increasing air pressure of the second line, and decreasing and increasing air pressure of the third line is performed in 15 minutes for all the three lines, by allotting 5 minutes, for example for each line. In this way, in normal control mode, air cells 3 are inflated and deflated at a cycle of 15 minutes to thereby prevent the bed user from getting bedsores. At the time of normal use of this air mattress, the air supply/discharge pump 11 is driven by the second power output that is lower than the first power output. It as preferable that the second power output lower than the first power output is designated as low as possible so that the operation noise arising during drive of the air supply/discharge pump 11 will not offend the bed user. On the other hand, in order to prevent bedsores, air cells 3 need to be inflated and deflated alternately at a frequency equal to or higher than the predetermined cycle. Accordingly, it is necessary to determine the power output of the air supply/discharge pump 11 in the normal use mode, taking into account the operation noise of the air supply/discharge pump 11 and the frequency (cycle) of alternate inflation and deflation to prevent bedsores. For example, the air supply/discharge pump 11 may be driven in this normal mode by applying a.c. 34V so as to feed air at a flow rate of 6 to 8 Nlit./min. In this setting, the average air supply/discharge pump can be driven with an operating sound of 30 dB or lower, hence making it possible to suppress the noise to as low as not to disturb sleep and the like of the patient lying on the bed.

Meanwhile, in the gatch bed shown in FIG. 1, there occurs a case where at the time of back-raising operation, the weight of the bed user acts concentratedly on the buttock section 10*d* and presses and shrinks air calls 3 in this buttock section 10*d* so that the bed user sinks into the air mattress 2. If this happens, the buttocks of the bed user abut against the buttock bottom 1*c*, causing so-called bottom touch, hence giving unconformable feeling to the bed user. In such a case, it is possible to prevent bottom touch by raising air pressure of air cells 3 corresponding to the buttock section 10*d* and therearound at the time of back-raising operation. Also in this case, a third power output lower than the first power output is used to drive air supply/discharge pump 11, whereby it is possible to avoid uncomfortable noise offending the bed user lying on the bed.

Next, the operation of the present embodiment thus configured will be described. When a large amount of air is supplied into many air cells 3 such as when the air mattress 2 is initially operated or restarted after maintenance, the air supply/discharge pump 11 is driven with the first power output that gives nearly the maximum drive capacity, in order to inflate the air cells 3 as soon as possible. Though at this time the air supply/discharge pump 11 gives off a relatively high operation sound, it does not matter in terms of noise because no patient is lying on the bed. Since the air supply/discharge pump 11 is operated at the driving force close to the maximum capacity, all the air cells 3 can be inflated rapidly, hence making it possible to reduce burden on the nurse. On the other hand, when, at the time of normal operation mode in which the bed user is lying on the bed, the air supply/discharge pump 11 needs to be driven to perform alternate inflation and deflation or prevention against bottom touch, the air supply/discharge pump 11 is driven with the second or third power output lower than the first power output. Thus, it is possible to prevent the bed user from being offended by the noise caused by the driving sound at driving the air supply/discharge pump 11. Since air supply and discharge in the normal operation mode is performed not for all the air cells 3 but for part of the air cells, and since the inflating and deflating rates at this mode need not to be necessarily high, it does not matter in view of operation if the driving force of the air supply/discharge pump 11 is set low.

Though in the present embodiment three level power control comprising the first power output, second power output and third power output is used as described above, the invention should not be limited to this. It is of course possible to use two-level power control of the first power output and the second power output lower than the former, or use power control comprising four levels or more on one hand. As the other cases where high power or the first power output is set up, on the occasions when the entire air mattress is wanted to be increased in pressure such as when the patient undergoes rehabilitation on the bed, when the patient sits at the edge of the bed and when back raising is operated in the gatch bed, the pump is set up at the first power output that is the high power close to the maximum pumping capacity.

INDUSTRIAL APPLICABILITY

With the air mattress having inflating and deflating functions, it is possible to achieve rapid pressure adjustment and alleviate bed user's uncomfortable sensation due to operation sound of the pump when pressure adjustment is performed, hence enhance the usability of the mattress of this kind.

DESCRIPTION OF REFERENCE NUMERALS

1*a* to 1*f*: bottoms
2: air mattress
3: air cell
11: air supply/discharge pump
15: mattress control circuit

The invention claimed is:

1. An air mattress having inflating and deflating functions, comprising:

a plurality of air cells, the air cells extending to a bed width direction and being arranged in parallel in a bed longitudinal direction;

an air supply/discharge pump for performing air supply and air discharge for each of the air cells; and, a control circuit that controls the air supply and the air discharge for each of the air cells by the air supply/discharge pump to control increase and decrease of air pressure inside the air cells, wherein the air supply/discharge pump has a capability of supplying air to the air cells from a pressureless state in which all the air cells are pressureless to an inflated state in which all the air cells are inflated to a maximum pressure, within a predetermined period of time, and, the control circuit sets the power of the pump at a first power output equal to or lower than a maximum capacity when the pump inflates the air cells from the state in which the air cells are pressureless to a normal use state, and a maximum power of the pump when the air cells are selectively and alternately inflated and deflated is set at a second power output lower than the first power output.

2. The air mattress having inflating and deflating functions according to claim 1, wherein the first power output is set when the air mattress is initially operated or when restarted after maintenance.

3. The air mattress having inflating and deflating functions according to claim 2, wherein the air mattress is set on a plurality of bottoms including a back bottom, and, the control circuit sets the power of the pump at a third power output lower than the first power output when the pressure of the air cells located corresponding to a buttock of a bed user is increased at the time of a back raising operation for raising the back bottom.

4. The air mattress having inflating and deflating functions according to claim 2, wherein the air cells arranged in a longitudinal end on a leg side are sized shorter with respect to the bed width direction than those in the other part, and the air supply/discharge pump is mounted in a space on the bed between the short-sized air cells and the bed side edge where no air cells occupy.

5. The air mattress having inflating and deflating functions according to claim 1, wherein the air cells arranged in a longitudinal end on a leg side are sized shorter with respect to the bed width direction than those in the other part, and the air supply/discharge pump is mounted in a space on the bed between the short-sized air cells and the bed side edge where no air cells occupy.

6. The air mattress having inflating and deflating functions according to claim 1, wherein the air mattress is set on a plurality of bottoms including a back bottom, and, the control circuit sets the power of the pump at a third power output lower than the first power output when the pressure of the air cells located corresponding to a buttock of a bed user is increased at the time of a back raising operation for raising the back bottom.

7. The air mattress having inflating and deflating functions according to claim 1, wherein the first power output is set when a patient undergoes rehabilitation, when the patient sits at an edge of a bed, or when back raising is operated in a gatch bed.

8. The air mattress having inflating and deflating functions according to claim 7, wherein the air mattress is set on a plurality of bottoms including a back bottom, and, the control circuit sets the power of the pump at a third power output lower than the first power output when the pressure of the air cells located corresponding to a buttock of a bed user is increased at the time of a back raising operation for raising the back bottom.

9. The air mattress having inflating and deflating functions according to claim 7, wherein the air cells arranged in a longitudinal end on a leg side are sized shorter with respect to the bed width direction than those in the other part, and the air supply/discharge pump is mounted in a space on the bed between the short-sized air cells and the bed side edge where no air cells occupy.

10. A control method for an air mattress having inflating and deflating functions, the air mattress comprising:

a plurality of air cells, the air cells extending to a bed width direction and being arranged in parallel in a bed longitudinal direction;

an air supply/discharge pump for performing air supply and air discharge for each of the air cells; and, a control circuit that controls the air supply and the air discharge for each of the air cells by the air supply/discharge pump to control increase and decrease of air pressure inside the air cells, wherein the air supply/discharge pump has a capability of supplying air to the air cells from a pressureless state in which all the air cells are pressureless to an inflated state in which all the air cells are inflated to a maximum pressure, within a predetermined period of time, the control method comprising the steps of:

setting the power of the pump at a first power output equal to or lower than a maximum capacity when the pump inflates the air cells from the state in which the air cells are pressureless to a normal use state, and setting a maximum power of the pump when the air cells are selectively and alternately inflated and deflated at a second power output lower than the first power output.

* * * * *